US008777223B2

(12) United States Patent
Luck et al.

(10) Patent No.: US 8,777,223 B2
(45) Date of Patent: Jul. 15, 2014

(54) GAME OF ROULETTE

(75) Inventors: Kent W. Luck, Shawnee, KS (US); Kevin B. Luck, Spring, TX (US)

(73) Assignee: Double Luck Gaming LLC, Spring, TX (US)

( * ) Notice: Subject to any disclaimer, the term of this patent is extended or adjusted under 35 U.S.C. 154(b) by 0 days.

(21) Appl. No.: 13/430,482

(22) Filed: Mar. 26, 2012

(65) Prior Publication Data

US 2013/0249167 A1 Sep. 26, 2013

(51) Int. Cl.
*A63F 5/02* (2006.01)
*A63F 5/00* (2006.01)

(52) U.S. Cl.
CPC ..... *A63F 5/00* (2013.01)
USPC ..... 273/142 E; 273/274; 273/138.1

(58) Field of Classification Search
USPC ..... 273/142 E, 138.1, 274
See application file for complete search history.

(56) References Cited

U.S. PATENT DOCUMENTS

| | | | | |
|---|---|---|---|---|
| 6,352,260 | B1 * | 3/2002 | Santiago | 273/274 |
| 7,758,049 | B2 * | 7/2010 | Johnston | 273/274 |
| 2006/0170155 | A1 * | 8/2006 | Silverman | 273/142 R |
| 2012/0322529 | A1 * | 12/2012 | Gilbertson | 463/17 |

* cited by examiner

*Primary Examiner* — Benjamin Layno
(74) *Attorney, Agent, or Firm* — Muskin & Farmer LLC

(57) ABSTRACT

A method for a roulette game played by at least one player and a roulette wheel and ball to cooperate with the roulette wheel to indicate a winning number may include the steps of: providing a first area to provide a winning number only based on the winning number indicated by the ball in the roulette wheel in a first operation of the ball and roulette wheel; providing a second area defining a group of winning numbers to provide the player to advance to a second operation of the ball and roulette wheel which would provide another chance for a winning number.

6 Claims, 2 Drawing Sheets

GAME OF ROULETTE

FIELD OF THE INVENTION

This invention relates to the field of roulette and more particularly to a game of roulette and a playing board for the game of roulette.

BACKGROUND

Roulette is one of the most popular and well-known casino games steeped in tradition and excitement. In such game, a wheel with colored and numbered areas, e.g., depressions, delineated cages, etc., is spun on its vertical axis after which a ball is introduced upon the moving rotating wheel surface until the ball ultimately comes to rest upon one of such numbered areas.

It is well recognized that as the wheel slows in speed and the movement of the ball moving and/or bouncing along the wheel's surface slows as well, observers, e.g., those bettors playing the game, have a better idea, that is, heightened odds, of choosing which of the numbered or colored areas the ball will ultimately come to rest upon thus determining the winner. The casino employee, dealer or croupier overseeing the table normally controls the movement when no more bets may be placed on the outcome of where the ball will rest and this call or decision is made on the basis of experience and judgment and preferably before the wheel slows to a point where the players can see where or which area of the wheel the ball is going to ultimately rest upon. In other words, the dealer or croupier that is overseeing the table has to not only judge when to terminate further betting based on the speed of the rotating wheel and to some extent the speed and other ball movement, but the croupier must also rule as to whether or not any of the players, i.e., bettors, have improperly placed or withdrawn bets after the "No More Bets" verbal announcement is made. The croupier thus has to observe the ball, the wheel, their relative speeds and movements as well as simultaneously observe whether any bets were made, withdrawn or modified after the "No More Bets" announcement was made.

Another feature of a casino style roulette table is that there is a designated betting area generally rectangular in shape and with a defined perimeter and divided with generally square or rectangular betting areas corresponding to the roulette wheel's numbers and colors and on which betting areas the players place chips in order to register their bets on the outcome of the wheel spin. The players sit adjacent to this betting area while the croupier generally sits or stands across from the players and the wheel at the other tableside. Players may place, modify or remove chips at any time prior to the "No More Bets" call by either having the croupier do so or by actually moving their hands across the periphery of the betting area and manipulating the chips into or away from the individual betting areas. Obviously, the croupier has to closely monitor these player actions and be sure no betting takes place after the "No More Bets" call.

SUMMARY

A method for a roulette game played by at least one player and a roulette wheel and ball to cooperate with the roulette wheel to indicate a winning number may include the steps of:

providing a first area to provide a winning number only based on the winning number indicated by the ball in the roulette wheel in a first operation of the ball and roulette wheel;

providing a second area defining a group of winning numbers to provide the player to advance to a second operation of the ball and roulette wheel which would provide another chance for a group of winning numbers.

The number of winning numbers may be 1
The number of winning numbers may be 2.
The number of winning numbers may be 3.
The number of winning numbers may be 4.
The number of winning numbers may be 5.
The number of winning numbers may be 6.
The number of winning numbers may be 7.
The number of winning numbers may be 8.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
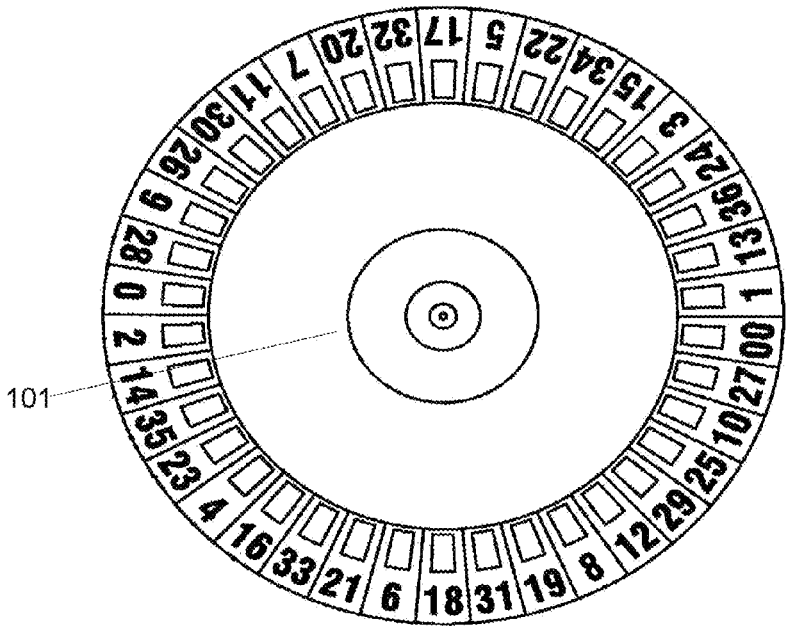
FIG. 1 illustrates a top view of the roulette wheel of the present invention.
Figure 2:
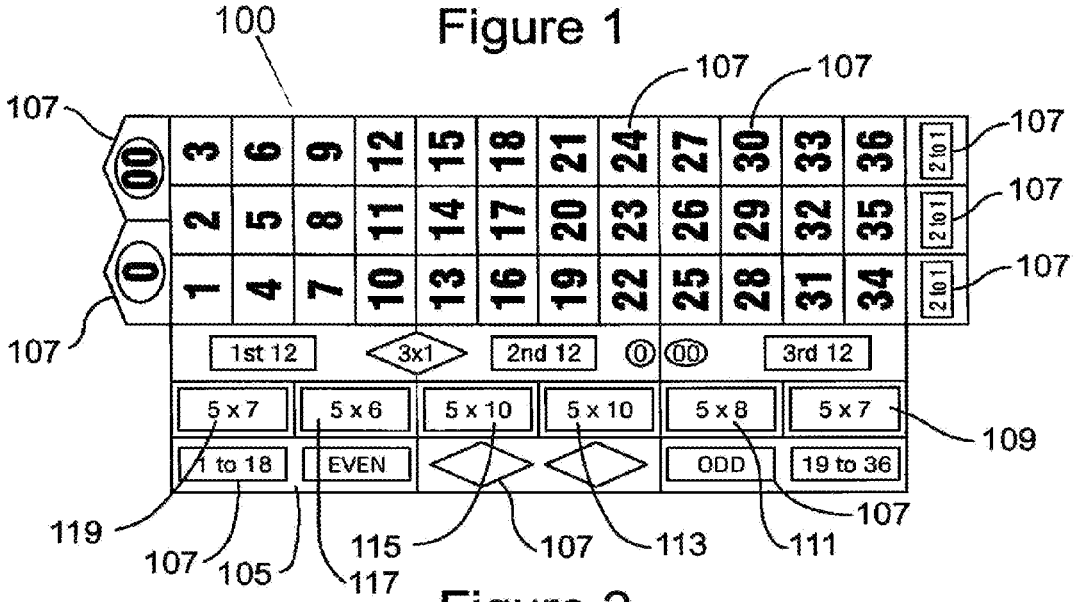
FIG. 2 illustrates a top view of the betting board for the game of roulette.
Figure 3:
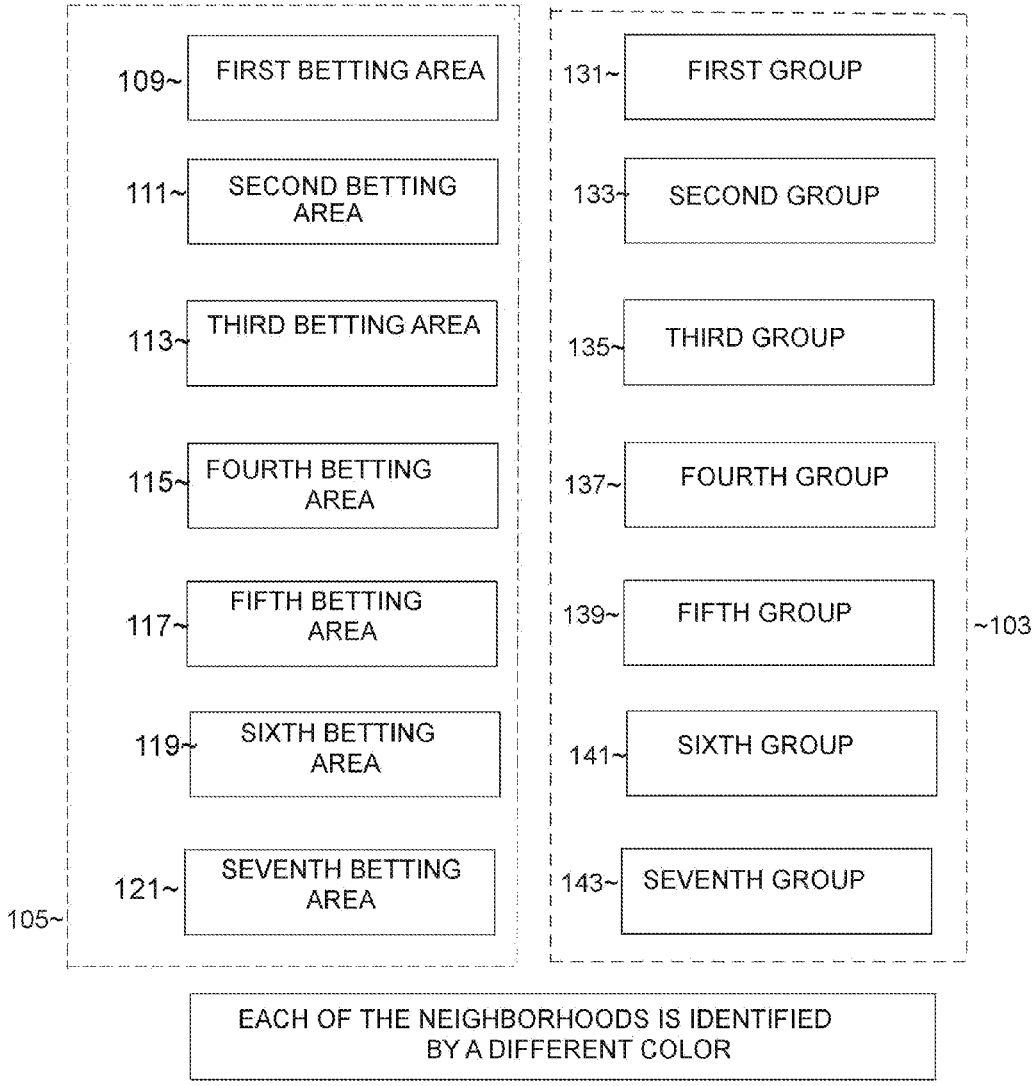
FIG. 3 illustrates all the predefined groups of betting numbers and betting areas of the present invention.

In the game of roulette, a roulette wheel 101 with a multitude of colored and numbered areas 103, e.g., depressions, delineated cages, etc. may be positioned around the roulette wheel 101, is spun on its vertical axis after which a ball is introduced upon the moving rotating wheel surface until the ball ultimately comes to rest upon one of such numbered areas. The roulette numbered areas 103 may be substantially identical in order to achieve a substantially equal probability that the ball will end up within any one of the numbered areas 103 and the numbered areas 103 may be randomly numbered around the wheel surface.

There may be two types of roulette wheels. The first type may have 37 independent slots on a "European" roulette wheel while a second type may have 38 independent slots on the "American" version of a roulette wheel. Of the 37 slots on the European wheel, 1 of the slots is numbered "0" and identified by the background color green, while the remaining 36 slots are numbered 1-36, and are identified in alternating background colors of red and black. Of the 38 slots on the American wheel, 2 of the slots may have a background color green and marked with the numbers "0" and "00", while the remaining 36 slots may be numbered 1-36, and are identified in alternating background colors of red and black. Other types of wheels may be possible.

Another feature of a casino style roulette table is that there is a designated betting board area 105 generally rectangular in shape and with a defined perimeter and divided with generally square or rectangular betting areas 107 corresponding to the roulette wheel's numbers and colors and on which betting areas the players place chips in order to register their bets on the outcome of the wheel spin. The betting areas 107 are either won or lost in a single or first roll of the ball on the roulette wheel 101. The establishment operating the roulette wheel 101 may collect the losing bets or pay off the winning bets in accordance with the number that the ball finally comes to rest in. For these players, there is no opportunity for the bet to be extended to a second operation of the roulette wheel 101. This does not extend the excitement and enjoyment of the betting experience. The players sit adjacent to this betting area while the croupier generally sits or stands across from the players and the wheel at the other tableside. Players may place, modify or remove chips at any time prior to the "No More Bets" call by either having the croupier do so or by actually moving their hands across the periphery of the betting area and manipulating the chips into or away from the individual betting areas. Obviously, the croupier has to closely monitor these player actions and be sure no betting takes place after the "No More Bets" call.

The layout 100 is modified from a convention roulette layout by adding a predefined group of betting numbers which may be a multiple of betting numbers which may range from two to a predetermined number. FIG. 1 illustrates a first group 131 which may include the numbers 13, 36, 24, 3, 15 which may be substantially adjacent to each other. A second group 133 may include the numbers 12, 29, 25, 10. A third group 135 may include the numbers 6, 18, 31. A fourth group 137 may include the numbers 14, 35, 23, 4, 16. A fifth group 139 may include the numbers 11, 30, 26, 9. A sixth group 141 may include the numbers 32, 17, 5 and a seventh group 143 which may include the numbers 34, 22, 20, 7, 33, 21, 19, & 8 which may not be all adjacent to each other and which may have a smaller subset of numbers which may be adjacent and may be positioned at different locations on the roulette wheel 101. An eighth group may include the numbers 28, 0, 2, 27, 00, 1 which may not be all adjacent and may be positioned at different locations on the roulette wheel 101. The group of numbers 131, 133, 135, 137, 139, 141, 143 may be identified by a common feature on the roulette wheel 101 which may be a common color such as blue, orange, yellow, etc., a common special symbol such as $, &, %, etc., or any other image.

Additional betting areas may be positioned on the betting board area 105 such as the first betting area 109 may be for placing the bets for the fourth group 137, the second betting area 111 may be for placing the bets for the second group 133, the third betting area 113 may be for placing bets for the third group 135, the fourth betting area 115 may be for placing bets for the sixth group 141, the fifth betting area 117 may be for placing bets for the fifth group 139, the sixth betting area 119 may be for placing bets for the first group 131, and a seventh betting area 121 may be for placing bets for the seventh group 143.

The present invention provides additional betting options with predetermined sections of group numbers on the roulette wheel 101 which may be known as "neighborhoods". These neighborhood sections may be identified by any additional coloring other than the already utilized red, black, and green colors. On the American version of the roulette wheel 101, one alternative may be to group the total 38 independent spots into the following sections: 2 neighborhoods having 3 roulette numbered areas 103 each; 2 neighborhoods of 4 roulette numbered areas 103 each; 2 neighborhoods of 5 roulette numbered areas 103 each; 1 neighborhood of 6 roulette numbered areas 103; and 1 neighborhood of 8 roulette numbered areas 103. On the European version of the wheel, the 37 independent roulette numbered areas 103 would be divided into the following sections: 2 neighborhoods consisting of 3 roulette numbered areas 103 each; 2 neighborhoods of 4 roulette numbered areas 103 each; 3 neighborhoods of 5 roulette numbered areas 103 each; and 1 neighborhood of 8 roulette numbered areas 103. As a result of these neighborhood additions to each version of the roulette wheel, corresponding sections to identify the respective neighborhoods would be added to the betting layout and paid a fraction of true odds to winning bets.

The present invention provides for a bet which would not lose as long as the ball does not land on one of the numbers within the numbered group. For example, A third group 135 may include the numbers 6, 18, and 31, and if the ball should land on any one of these numbers for example 31, the bet wins and is paid a fraction of odds. If the ball would land outside of these numbers, then the bet also would not necessarily lose. This bet would only lose if the ball should land in any of the numbers of the seventh group 143 for example 19. All other non-winning neighborhood wagers are allowed to remain on the betting layout and considered to "push", thus allowing the bettor the option of utilizing the "pushed" wager at his/her discretion. In conclusion, this enhancement would create a "multiple roll" version of the game of roulette because every wager would not be won or lost on a single-roll outcome.

Conversely, if a bettor places a wager on seventh group 143 on the layout in betting area 121, the outcome must result in the ball landing on any number of the seventh group 143 on the first roll. For example, if the ball lands in the number 8, the winning wager would be paid a fraction of true odds. If the ball lands on any other number not included in the seventh group 143, for example 12, then the bet loses.

Bettors place bets for the game of roulette. Some bettors place bets on non-group betting areas and bettors place bets on the first group 131. The ball is dropped on a rotating roulette wheel 101. It is well recognized that as the wheel slows in speed and the movement of the ball moving and/or bouncing along the wheel's surface slows as well, observers, e.g., those bettors playing the game, have a better idea, that is, heightened odds, of choosing which of the numbered or colored areas the ball will ultimately come to rest upon thus determining the winner. The casino employee, dealer or croupier overseeing the table normally controls the movement when no more bets may be placed on the outcome of where the ball will rest and this call or decision is made on the basis of experience and judgment and preferably before the wheel slows to a point where the players can see where or which area of the wheel the ball is going to ultimately rest upon. The croupier thus has to observe the ball, the wheel, their relative speeds and movements and provides a "No More Bets" announcement.

For example, the ball lands on the area corresponding to the number 31, and the bettors who had placed a bet on number 31 in the traditional manner are paid. The bettor who placed a bet on the first betting area 109 does not lose but may push his bet to the next roll of the ball on the roulette table 101.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A method to play a roulette game comprising:

providing a roulette wheel apparatus with at least 36 individual numbered slots;

providing 36 numbered betting areas numbered from 1 to 36, and providing numbered betting area rules comprising that a bet placed on a selected numbered betting area out of the 36 numbered betting areas wins when a result of a spin equals the selected numbered betting area and loses when the result of the spin does not equal the selected numbered betting area;

providing a first neighborhood betting area associated with a first neighborhood set consisting of a plurality of predetermined numbers on the roulette wheel, and providing first neighborhood betting area rules comprising that a bet placed in the first neighborhood betting area wins when the result is in the first neighborhood set and loses when the result is not in the first neighborhood set;

providing a plurality of additional neighborhood betting areas associated with respective additional neighborhood sets consisting of a plurality of predetermined numbers on the roulette wheel, and providing additional neighborhood betting area rules comprising that a bet placed in one of the plurality of additional neighborhood betting areas wins when the result is in the respective additional neighborhood set and loses when the result is in the first neighborhood set and remains in play for all other outcomes;

receiving bets from a player;

spinning the roulette wheel which determines the result of the spin; and resolving any bets placed in the numbered betting areas according to the numbered betting area rules;

resolving any bets placed in the first neighborhood betting area according to the first neighborhood betting area rules; and resolving any bets placed in the additional neighborhood betting areas according to the additional neighborhood betting area rules, wherein no number associated with any of the neighborhoods is associated with more than one of the neighborhoods, the neighborhoods comprising the first neighborhood and the additional neighborhoods.

2. The method as recited in claim 1, wherein the roulette wheel also comprises a single zero slot but not a double zero slot and the numbered betting areas also comprise a single zero betting area but not a double zero betting area.

3. The method as recited in claim 1, wherein the roulette wheel also comprises a single zero slot and a double zero slot and the numbered betting areas also comprise a single zero betting area and a double zero betting area.

4. The method as recited in claim 1, wherein when a bet on one of the additional neighborhood betting areas remains in play the player has the option of removing the bet on one of the additional neighborhood betting areas.

5. The method as recited in claim 1, further comprising, when a bet placed on one of the plurality of additional neighborhood betting areas remains in play, then continuing spinning of the roulette wheel until the bet placed on one of the plurality of additional neighborhood betting areas falls in a bet completed set consisting of win and lose.

6. The method as recited in claim 1, wherein each of the neighborhoods is identified by a different color.

* * * * *